US005997439A

United States Patent [19]

Ohsuga et al.

[11] Patent Number: 5,997,439

[45] Date of Patent: Dec. 7, 1999

[54] BEDSIDE WELLNESS SYSTEM

[75] Inventors: Mieko Ohsuga; Masahiro Kimura, both of Tokyo; Hiroshi Oyama, Chiba, all of Japan

[73] Assignee: Mitsubishi Denki Kabushiki Kaisha, Tokyo, Japan

[21] Appl. No.: 08/864,946

[22] Filed: May 29, 1997

[30] Foreign Application Priority Data

Nov. 25, 1996 [JP] Japan ..... 8-313954

[51] Int. Cl.[6] ..... G09B 9/02

[52] U.S. Cl. ..... 482/4; 482/904; 434/247

[58] Field of Search ..... 482/1–9, 44–46, 482/51, 54, 57, 900–902; 434/29–51, 55, 61, 247

[56] References Cited

U.S. PATENT DOCUMENTS 5,577,981 11/1996 Jarvik ..... 482/4
5,782,639 7/1998 Beal ..... 434/29
5,788,618 8/1998 Joutras ..... 482/5

FOREIGN PATENT DOCUMENTS 63-120606 8/1988 Japan .
4-348761 12/1992 Japan .
7-80096 3/1995 Japan .

*Primary Examiner*—Glenn E. Richman
*Attorney, Agent, or Firm*—Sughrue, Mion, Zinn, Macpeak & Seas, PLLC

[57] ABSTRACT

A bedside wellness system is provided with an exercise load providing unit for providing a load of a physical exercise for a user who lies in bed, and for measuring a movement of the user who is doing the physical exercise, a virtual reality environment providing unit for providing the user with a virtual reality environment which causes user's plural human senses to work according to the contents of the virtual reality environment, and a control unit for controlling the virtual reality environment provided by the virtual reality environment providing unit according to the user's movement measured by the exercise load providing unit. Furthermore, the wellness system can include a physiological and psychological condition evaluating unit for acquiring information about a user's physiological condition so as to evaluate the user's physiological condition, and the control unit can control the load of the physical exercise provided by the exercise load providing unit according to the user's physiological condition evaluated by the physiological and psychological condition evaluating unit.

12 Claims, 6 Drawing Sheets

BEDSIDE WELLNESS SYSTEM

BACKGROUND OF THE INVENTION

1. Field of the Invention

The present invention relates to a bedside wellness system which can provide a rehabilitation physical exercise, intended for, for example, a patient who stays in a medical institution and lies in bed, and a patient or a person of advanced age who stays at a health care institution for the aged or at home and lies in bed. More particularly, the present invention relates to a bedside wellness system which can provide a virtual reality environment which can add a sense of sophisticated realism so as to cause such a patient to motivate himself or herself for rehabilitation, which usually bores the patient, so that the bedside wellness system can encourage a patient who stays in hospital to do early rising after an operation, and prevent a patient who has been receiving medical treatment for a long time from atrophying with disuse.

2. Description of the Prior Art

There has not existed a bedside wellness system intended for patients, which enables a patient who has no alternative but to be confined to bed to do an early rehabilitation exercise in the presence of a doctor, or according to instructions of a doctor, so as to prompt early rising and prevent the patient from atrophying with disuse. Some conventional training machines intended for the improvement of a person's health and physical strength have been used as a wellness system. An artificial-experience giving device equipped with a display, for providing a user with artificial experience in doing a target physical training exercise while seeing an image displayed on the screen of the display is one of such training machines. Referring now to FIG. 8, there is illustrated a schematic view of such a prior art artificial-experience giving device equipped with a display as disclosed in Japanese Patent Application Laying Open (KOKAI) No. 7-80096. In the figure, reference numeral 1 denotes a bicycle training machine, 2 denotes a pedal of the machine, 3 denotes a saddle of the machine, 4 denotes a projector which projects an image of an artificial scene, 5 denotes a screen shaped like a half-spherical dome, on which an image from the projector 4 is displayed, 6 denotes a blowing outlet out of which an artificial wind is blowing, 7 denotes a blowing box which produces the artificial wind, and 8 denotes a fragrant substance adding unit for adding a fragrant substance to the artificial wind.

When a user sits on the saddle 3 of the bicycle training machine 1 and then starts to pedal the bicycle training machine, the projector 4 projects an image on the screen 5 shaped like a half-spherical dome and located at the front of the bicycle training machine 1. In general, the image displayed on the screen is concerned with an artificial scene in the vicinity of an artificial road on which the bicycle is moving, and the image is controlled so that the artificial scene is varied according to the speed at which the user pushes the pedals 2 around, that is, the scene moves at a high speed when the user pedals fast and the scene moves at a low speed when the user pedals slowly. In addition, a wind from the blowing outlet 6 located at the front of the user is blowing toward the user. The velocity of the wind is controlled according to the speed at which the user pushes the pedals around, similarly to the speed of a variation in the image projected on the screen. Furthermore, the prior art artificial-experience giving device equipped with a display is adapted to control the load of a physical exercise imposed on the user and select a fragrant substance to be added to the artificial wind according to the contents of the image displayed on the screen so as to provide the user with a sense of realism, for example, increase the load of the bicycle training when an image of an upward slope is displayed on the screen, decrease the load of the bicycle training when an image of an downward slope is displayed on the screen, or add a fragrant substance including phytoncide as a major constituent to the artificial wind blowing out of the blowing outlet 6 by means of the fragrant substance adding unit 8 in a situation wherein the user is going on a bicycle trip in a wood.

While the prior art wellness system, which is implemented via such the conventional artificial-experience giving device equipped with a display and which is so constructed as mentioned above, is effective in improving the health and physical strength of a person of health, and recovering the physical strength of a patient who is almost restored in health, the prior art wellness system is not effective in providing early rehabilitation for a patient who has no alternative but to be confined to bed, in the presence of a doctor, or according to instructions of a doctor, so as to prompt early rising and prevent the user from atrophying with disuse. While the prior art wellness system has a measure to display an image in order to cause the user to motivate himself or herself to do a rehabilitation exercise, it cannot add a sense of realism to a sufficient degree. For example, the prior art wellness system cannot provide a vibration which varies according to the condition of a road surface on which a user walks in a virtual reality environment so as to cause the user to have a feeling of stepping on something. When the prior art wellness system shows an image of trees nodding in a wind or leaves being swayed by the wind, the velocity of the wind blowing out of the blowing outlet 6 cannot reflect that of the wind blowing in the image, which can be expected from the scene of the image, and therefore the load of the physical exercise that the user is doing cannot reflect the resistance of the wind which can be estimated from the image. Furthermore, since the prior art wellness system does not have a function of forcefully helping a patient who cannot do a physical exercise at the patient's will to do that, it has no effect on bedridden patients. In addition, another problem with the prior art wellness system is that a measure is not taken to stop the wellness system when a patient who is using the prior art wellness system gets himself or herself absorbed in an artificial environment created by the wellness system to excess and does a physical exercise to excess.

SUMMARY OF THE INVENTION

The present invention is made in order to overcome the above problems. It is therefore an object of the present invention is to provide a bedside wellness system which can provide a user who lies in bed such as a bedridden patient or a person of advanced age with a rehabilitation physical exercise and an image that does not put a burden upon the user to prompt the user to do early rising, and prevent the user from atrophying with disuse.

It is another object of the present invention to provide a bedside wellness system which can provide a virtual reality environment which adds a sense of realism, and which can be acted upon by the physical exercise that the user is doing, so that the bedside wellness system can be applied to a user who has little desire to do rehabilitation, thereby realizing the realism and the interaction with the virtual reality environment which have been impossible in the prior art to cause the user to motivate himself or herself for rehabilitation and simultaneously cause the user to mentally refresh himself or herself from the experience of the virtual reality world.

It is a further object of the present invention to provide a bedside wellness system which can control the virtual reality environment according to a user's psychological condition estimated from physiological information about the user who lies in bed to provide a more effective image of the virtual reality environment and produce a synergistic rehabilitation effect, and which can monitor the load of the physical exercise from the physiological information about the user who lies in bed to prevent the user from getting himself or herself absorbed in the virtual reality world created by the bedside wellness system to excess and therefore doing a physical exercise to excess, thereby causing the user who lies in bed to actively do an appropriate physical exercise in safety.

In accordance with one aspect of the present invention, there is provided a bedside wellness system comprising an exercise load providing unit for providing a load of a physical exercise for a user who lies in bed, and for measuring a movement of the user who is doing the physical exercise, a virtual reality environment providing unit for providing the user with a virtual reality environment which causes user's plural human senses to work according to the contents of the virtual reality environment, and a control unit for controlling the virtual reality environment provided by the virtual reality environment providing unit according to the user's movement measured by the exercise load providing unit.

In accordance with another aspect of the present invention, there is provided a bedside wellness system comprising, an exercise load providing unit for providing a load of a physical exercise for a user who lies in bed, and for measuring a movement of the user who is doing the physical exercise, a virtual reality environment providing unit for providing the user with a virtual reality environment which causes user's plural human senses to work according to the contents of the virtual reality environment, a physiological and psychological condition evaluating unit for acquiring information about a user's physiological condition so as to evaluate a user's psychological condition, and a control unit for controlling the virtual reality environment provided by the virtual reality environment providing unit according to the user's psychological condition evaluated by the physiological and psychological condition evaluating unit.

In accordance with a preferred embodiment of the present invention, the virtual reality environment providing unit includes a sound providing unit which can stereophonically provide the user with a sound which is emitted out of at least one sound source according to an image of the virtual reality environment to be provided by the virtual reality environment providing unit.

Preferably, the control unit can furnish sound source information about at least a sound source to be located in the virtual reality environment to be provided by the virtual reality environment providing unit and three-dimensional position information about a three-dimensional position of the sound source to the sound providing unit. Furthermore, the sound providing unit includes a sound data storing unit for storing data about a sound which the sound source emits, a sound control unit for reading sound data about the sound source from the sound data storing unit on the basis of the sound source information and the three-dimensional position information so as to furnish the sound data, a stereophonic sound reproducing unit for pinpointing the location of the sound source in a sound space of the virtual reality environment on the basis of the three-dimensional position information from the control unit so as to reproduce a stereophonic sound field of the virtual reality environment from the sound data from the sound control unit so that the user can feel as if the sound is emitted out of a corresponding position of the sound source in the sound space of the virtual reality environment, and a sound generating unit for providing the stereophonic sound field reproduced by the stereophonic sound reproducing unit for the user who lies in bed.

Preferably, the sound generating unit includes a headphone, and the stereophonic sound reproducing unit can reproduce the stereophonic sound field of the virtual reality environment by using a head reiiated transfer function of a sound travelling from the sound source to the user's eardrum. Alternatively, the sound generating unit can include at least a pair of speakers.

In accordance with another preferred embodiment of the present invention, the virtual reality environment providing unit includes a unit for adjusting the hardness of a bed on which the user lies, a unit for adjusting the temperature of the inside of the bed, and a unit for adjusting the humidity of the inside of the bed, and wherein the control unit controls the hardness adjusting unit, the temperature adjusting unit, and the humidity adjusting unit according to an image of the virtual reality environment to be provided.

Preferably, the hardness adjusting unit can adjust the hardness of the bed by adjusting the pressure of fluid included in the bed such as air, water, or gel liquid, the temperature adjusting unit can adjust the temperature of the fluid, and the humidity adjusting unit can adjust the humidity of air fed into the bed. Alternatively, the hardness adjusting unit can adjust the hardness of the bed by adjusting the pressure of a mat which is placed under the user, the temperature adjusting unit can adjust the temperature of a predetermined position of the mat, and the humidity adjusting unit can adjust the humidity of air emitted out of the mat.

In accordance with another preferred embodiment of the present invention, the virtual reality environment providing unit includes an image display unit for displaying an image of the virtual reality environment according to the contents of the virtual reality environment for the user who lies in bed, and a unit for movably supporting the image display unit and positioning it at a desired position.

In accordance with another preferred embodiment of the present invention, the virtual reality environment unit includes an image display having a screen which is so shaped as to surround the face of the user who lies in bed, and on which an image of the virtual reality environment is displayed.

In accordance with another aspect of the present invention, there is provided a bedside wellness system comprising an exercise load providing unit for providing a load of a physical exercise for a user who lies in bed, and for measuring a movement of the user who is doing the physical exercise, a physiological and psychological condition evaluating unit for acquiring information about a user's physiological condition so as to evaluate the user's physiological condition, and a control unit for controlling the load of the physical exercise provided by the exercise load providing unit according to the user's physiological condition evaluated by the physiological and psychological condition evaluating unit.

In accordance with a preferred embodiment of the present invention, the control unit includes a unit for informing an operator of the user's physiological condition evaluated by the physiological and psychological condition evaluating unit, and a unit for receiving an instruction input by the operator so as to control the load of the physical exercise provided by the exercise load providing unit according to the instruction.

Further objects and advantages of the present invention will be apparent from the following description of the preferred embodiments of the invention as illustrated in the accompanying drawings.

DETAILED DESCRIPTION OF THE PREFERRED EMBODIMENTS

Figure 1:
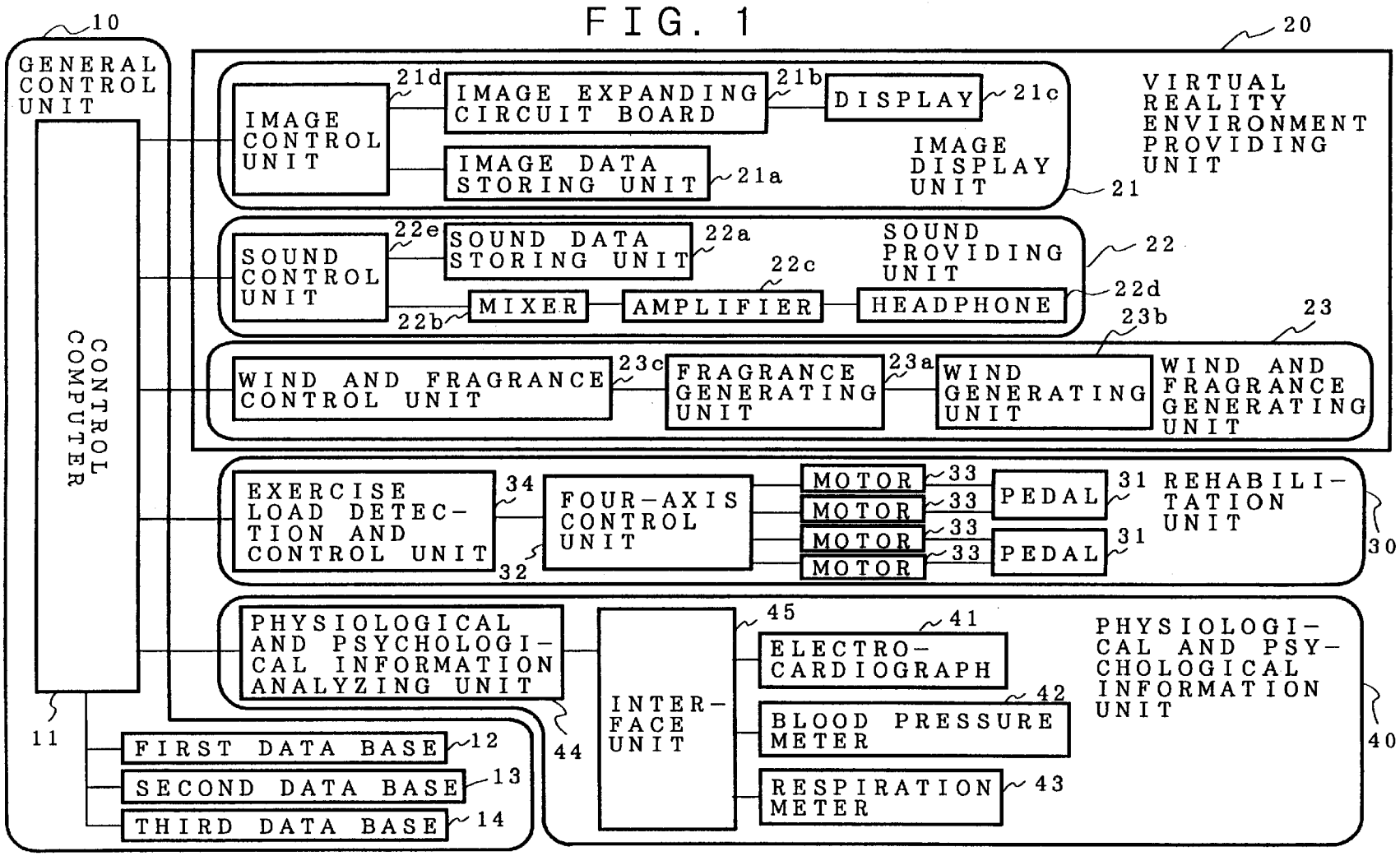
FIG. 1 is a block diagram of a bedside wellness system according to a first embodiment of the present invention.

Referring now to FIG. 1, there is illustrated a block diagram of a bedside wellness system according to a first embodiment of the present invention. In the figure, reference numeral 10 denotes a general control unit for controlling the whole of the bedside wellness system, 11 denotes a control computer disposed in the general control unit 10 for actually carrying out the control of the bedside wellness system, and 12 to 14 denote various kinds of data bases which were created in advance, and which can be used by the control computer 11 when it carries out a controlling operation. Reference numeral 12 denotes a first data base in which integrated information about a variety of contents of a virtual reality environment that can activate user's plural human senses is stored for creating a virtual reality environment to be provided for a user according to the contents of a physical exercise that the user is doing, 13 denotes a second data base in which control information about how to vary the virtual reality environment to be provided for the user according to the contents of a physical exercise that the user is doing is stored, and 14 denotes a third data base in which control information about how to vary the load of the physical exercise to be imposed on the user according to a variation in the user's physiological condition is stored.

Furthermore, reference numeral 20 denotes a virtual reality environment providing unit which is controlled by the control computer 11 of the general control unit 10, for providing the user with a virtual reality environment according to the contents of a physical exercise which the user is doing, 21 denotes an image display unit comprised of an image data storing unit 21*a* for storing image data about a variety of contents of the virtual reality environment, an image expanding circuit board 21*b* for expanding compressed image data read out of the image storing unit 21*a*, a display 21*c* for displaying an image of a virtual reality environment on the basis of the expanded image data from the image expanding circuit board 21*b*, and an image control unit 21*c* for controlling the image data storing unit 21*a*, image expanding circuit board 21*b* and display 21*c*, and 22 denotes a sound providing unit comprised of a sound data storing unit 22*a* for storing data about sounds to be made in the virtual reality environment, a mixer 22*b* for mixing sound data read out of the sound data storing unit 22*a*, an amplifier 22*c* for amplifying the sound data mixed by the mixer, a headphone 22*d* for providing sounds which construct a part of the virtual reality environment by using the amplified sound data, and a sound control unit 22*e* for controlling the sound data storing unit 22*a*, mixer 22*b*, amplifier 22*c*, and headphone 22*d*.

Furthermore, reference numeral 23 denotes a wind and fragrance generating unit comprised of a fragrance generating unit 23*a* for emitting fragrance which constructs a part of the virtual reality environment, a wind generating unit 23*b* for generating a wind which constructs a part of the virtual reality environment, and a wind and fragrance control unit 23*c* for controlling the fragrance generating unit 23*a* and wind generating unit 23*b*. The virtual reality environment providing unit 20 of the first embodiment is provided with the image display unit 21, the sound providing unit 22, and the wind and fragrance generating unit 23.

Reference numeral 30 denotes a rehabilitation unit, which is disposed as an exercise load providing unit, controlled by the control computer 11 of the general control unit 10, for imposing an appropriate exercise load on the user and for measuring a movement of the user who is doing the physical exercise. The rehabilitation unit 30 is provided with a pair of pedals for imposing an appropriate exercise load on the user by causing the user to do a stepping exercise, a four-axis control unit 32 for controlling the positions, angles, and speeds of the pair of pedals 31, four motors 33 each for driving a corresponding one of the pair of pedals 31 under control of the four-axis control unit 32, and an exercise load detection and control unit 34 for furnishing an instruction from the control computer 11 of the general control unit 10 to the four-axis control unit 32 and for detecting or measuring the user's movement by acquiring information about the positions, angles, and speeds of the pair of pedals 31 from the four-axis control unit 32, and then informing the control computer 11 of the detected result.

In addition, reference numeral 40 denotes a physiological and psychological information acquiring unit which is controlled by the control computer 11 of the general control unit 10, for acquiring information about physiology of the user who lies on bed, so as to estimate user's physiological and psychological conditions. The physiological and psychological information acquiring unit 40 is provided with an electrocardiograph 41 for measuring an electrocardiogram of the user who lies in bed, a blood pressure meter 42 for measuring the user's brood pressure, a respiration meter for measuring user's respiration, a physiological and psychological information analyzing unit 44 for analyzing the information about the user's physiological condition acquired by the electrocardiograph 41, blood pressure meter 42, and respiration meter 43 so as to estimate the user's physiological and psychological conditions, and an interface unit 45 which interfaces between the electrocardiograph 41, blood pressure meter 42, and respiration meter 43, and the physiological and psychological information analyzing unit 44.

In operation, the general control unit 10 controls each of the image display unit 21, sound providing unit 22, and wind and fragrance generating unit 23 of the virtual reality environment providing unit 20 by means of the control computer 11 so that they are synchronized with each other so as to generate a virtual reality environment that provides a user with a sense of realism, according to the contents of the virtual reality environment. Examples of the contents of the virtual reality environment provided can be forest bathing which causes the user to feel at ease, a place for which a user who lies in bed feels yearning, such as a row of stores and houses on a street where the user was brought up, and the user's house which is really apart from the user who stays in hospital. Control operations carried out by the control computer are, for example, to generate a signal for selecting an image to be provided by the display 21*c* of the image display unit 21, to generate a signal for controlling a sound phrase to be provided by the headphone 22*d* of the sound providing unit 22 according to the image on-screen, and to generate a signal for controlling a wind and fragrance to be provided by the wind generating unit 23*a* and fragrance generating unit 23*b* of the wind and fragrance providing unit 23. The control computer 11 can carry out such control operations by referring to the first data base 12 which was created in advance.

Simultaneously, the control computer 11 of the general control unit 10 determines a method of controlling the virtual reality environment to be provided by the virtual reality environment providing unit 20 by referring to the second data base 13, which was created in advance, on the basis of information about the physical exercise, which the user who lies in bed does, from the rehabilitation unit 30. That is, when controlling the virtual reality environment according to the rehabilitation physical exercise which the user who lies in bed is doing, the exercise load detection and control unit 34 of the rehabilitation unit 30 measures a movement of the user who is doing the physical exercise, e.g., a walking motion of the user, and then varies the replay speed of an image on-screen of the virtual reality environment provided by the display 21*c* of the image display unit 21 according to the measured movement of the user, e.g., the measured walking motion of the user. Simultaneously, the control computer 11 varies the sound to be emitted by the headphone 22*d* of the sound providing unit 22 and the wind and fragrance to be provided by the wind generating unit 23*a* and fragrance generating unit 23*b* of the wind and fragrance providing unit 23 according to the variation in the replay speed of the image on-screen. Thus, the scenery in the virtual reality environment and velocity of the wind blowing are varied according to the walking speed of the user who lies in bed, and the sound and fragrance provided are varied so as to match or correspond to the scenery in the virtual reality environment and the speed of the wind blowing.

The control computer 11 of the general control unit 10 determines a method of controlling the virtual reality environment provided by the virtual reality environment providing unit 20 by referring to the second data base 13, which was created in advance, on the basis of information about the user's psychological condition estimated by the physiological and psychological information acquiring unit 40 from the information about the user's physiological condition such as the heart rate, blood pressure, and respiration of the user who lies in bed. When the bedside wellness system of this embodiment controls the virtual reality environment according to the user's psychological condition, if the physiological and psychological information acquiring unit 40 determines that the user is in an excited state, the general control unit 10 controls the image display unit 21, sound providing unit 22, and wind and fragrance providing unit 23 so as to provide a virtual reality environment having gentle contents which cause the user to become calm, such as forest bathing. On the contrary, if the physiological and psychological information acquiring unit 40 determines that the user becomes bored, the general control unit 10 controls the image display unit 21, sound providing unit 22, and wind and fragrance providing unit 23 so as to provide a virtual reality environment having exciting contents such as an amusement park which causes the user to amuse himself or herself.

The control computer 11 of the general control unit 10 produces information for controlling the load of the physical exercise by referring to the third data base 13, which was created in advance, on the basis of information about the user's psychological condition estimated by the physiological and psychological information acquiring unit 40 from the information about the user's physiological condition such as the heart rate, blood pressure, and respiration of the user who lies in bed, and then the control computer controls the rehabilitation unit 30 according to the information for controlling the load of the physical exercise. In the third data base 14, how the control computer 11 varies the load of the physical exercise as the user's physiological condition varies is described according to the purpose of training. For example, a method of adjusting the load of the physical exercise according to characteristic quantities such as the user's heart rate and blood pressure, the frequency of irregular pulses, and variations in the waveform of the electrocardiogram, e.g., ST rising, can be defined in advance. More specifically, the user's heart rate and maximum blood pressure can be recorded before the user starts to be trained, and the physiological and psychological information acquiring unit 40 evaluates the effect of the load of the physical exercise, i.e., the labor strength from the rates of rises in the heart rate and maximum blood pressure during the user's physical exercise. Then, the control computer controls the load of the physical exercise in such a manner that the effect of the load of the physical exercise is constant. Furthermore, the control computer can control the load of the physical exercise discretely in such a manner that it restricts the load of the physical exercise or reduces the load of the physical exercise to zero when the user becomes a danger physiological state, for example, when a change in the waveform of the electrocardiogram occurs, or when detecting an increase in the number of irregular pulses.

The image display unit 21 of the virtual reality environment providing unit 20 receives the control signal furnished by the control computer 11 of the general control unit 10 through the image control unit 21*d*, and then it reads an image stored in the image storing unit 21*a* and replays it on the display 21*c* according to the control signal. When the image data stored in the image storing unit 21*a* is compressed, the image expanding circuit board 21*b* expands the image data, and, after that, the image display unit displays the expanded image data on the display 21*c*. The display 21*c* can be an open type display or a head mount display, so long as the user who lies in bed can see an image on the display while doing the physical exercise. Furthermore, the image display unit 21 can be provided with two image display systems which can respectively and independently control images which the user's left and right eyes can see so as to create a 3-D image or a wide-angle image.

In the sound providing unit 22, the sound control unit 22*e* reads data about sound phrases which correspond to the image to be displayed on the display 21*c* of the image display unit 21 according to an instruction from the control computer 11 of the general control unit 10, and then furnishes the sound data to the mixer 22*b* wherein the sound data are mixed. Then, the sound data mixed are amplified by the amplifier 22*c* and are provided for the user through the headphone 22*d*. When the contents of the virtual reality environment provided is about forest bathing, the mixed sound provided can be a mixture of the sound of footsteps which is created according to the positions of the user's feet, the movement of the user who is doing the physical exercise, which have been detected or measured by the exercise load detection and control unit 34, and the state of a place on which the user steps in the virtual reality environment displayed on the display 21*c* of the image display unit 21, and environmental sounds, which are made in the virtual reality environment, such as tree's rustlings or bird's twitterings. It is needless to say that, like the image display unit, the sound providing unit can be provided with a number of channels so as to provide a stereophonic sound by mixing sounds which are emitted out of a plurality of individual sound sources, thereby creating a sound environment which adds a sense of realism. The term "environmental sound" means a sound which can be emitted out of everywhere in an environment. Tree's rustlings in a forest in the virtual reality environment can be heard as if they are emitted from everywhere in the forest. On the contrary, there may be a case where a tree's rustlings or a bird's twitterings can be identified as a sound which is emitted out of an individual sound source such as a tree in the vicinity of the user or a small bird which flits about the sky above the user, as will be mentioned below.

In the wind and fragrance providing unit 23, the wind and fragrance control unit 23*c* controls the wind generating unit 23*a* and fragrance generating unit 23*b* in response to an instruction signal from the control computer 11 of the general control unit 10 so as to generate a wind and fragrance. With respect to the wind, examples of control parameters are the velocity and direction of the wind including variations, the temperature and humidity of the wind, the size or width of the wind adjusted by the width of an outlet through which the wind is blowing, and the degree of turbulence of the wind (e.g., Reynolds number). With respect to the fragrance, examples of control parameters are the kinds of fragrances, the quantities (e.g., strength) of fragrances, the ratio of a mixture of fragrances, the speed at which the strength of the mixture of fragrances provided is reduced, and the directions from which the fragrances come. The control computer 11 of the general control unit 10 determines these control parameters according to the image displayed on the display 21*c* of the image display unit 21. For example, when the contents of virtual reality environment provided is about forest bathing, the control computer 11 adds fragrances of flowers and trees in a forest to a wind which corresponds to the walking speed or tree's rustlings so as to provide the wind having the fragrances for the user who lies in bed.

The exercise load detection and control unit 34 of the rehabilitation unit 30 generates a control signal from another control signal for controlling the load of the physical exercise (e.g., a signal showing the type of a rehabilitation physical exercise which the user is to do, or the load of the physical exercise to be imposed on the user), which is furnished by the control computer 11 of the general control unit 10. Then, the exercise load detection and control unit 34 furnishes the control signal to the four-axis control unit 32. The four-axis control unit 32 drives the pair of left and right pedals 31 by respectively controlling the four motors 33 according to the control signal. Thus, the four-axis control unit 32 can control the four motors independently so as to cause the user who lies in bed to bend and stretch the user's left and right knees alternately and simultaneously turn the user's left and right ankles around. Furthermore, in addition to the control of the load of the physical exercise for rehabilitation, the bedside wellness system can increase the load of the physical exercise by controlling the pair of pedals 31 so that the user feels an increase in the resistance of the wind blowing in the virtual reality environment provided. Furthermore, the bedside wellness system can cause the user to feel as if the user steps on something. The exercise load detection and control unit 34 acquires further information about the movement of the user who is doing the physical exercise, e.g., the timing and strength of stepping, from information about the positions, angles, and speeds of the pair of pedals 31, which have been acquired by the four-axis control unit 32. Then, the exercise load detection and control unit 34 furnishes the information about the user's movement to the control computer 11 of the general control unit 10. In the above description, a knee bending exercise and ankle turning exercise are explained as an example of the rehabilitation physical exercise. The bedside wellness system of this embodiment can also be applied to another rehabilitation physical exercise such as bending and stretching an arm, turning an arm, turning a wrist, bending and stretching a finger, and turning a finger. Furthermore, as previously explained, the four-axis control unit 32 is equipped with 4 degrees of freedom, which respectively correspond the four elements of the physical exercise, i.e., bending and stretching the user's left leg, bending and stretching the user's right leg, turning the user's left ankle around, and turning the user's right ankle around, which can be controlled independently. A plurality of independent elements included in the rehabilitation physical exercise can be determined according to the type of the rehabilitation physical exercise, and therefore a plural-axis control unit equipped with plural degrees of freedom which corresponds to the number of the exercise elements can be used.

The physiological and psychological information acquiring unit 40 measures a user's electrocardiogram, blood pressure, and respiration by means of the electrocardiograph 41, the blood pressure meter 42, and the respiration meter 43, and then obtains information about the user's physiological condition such as the heart rate, the maximum, mean, and minimum blood pressure, the respiration, the magnitude of a variation in the heart rate, and the regularity of respiration, at predetermined intervals from the measured user's electrocardiogram, blood pressure, and respiration. The physiological and psychological information analyzing unit 44 estimates a variation in the user's physiological condition accompanied by the load of the physical exercise imposed on the user and then informs the control computer 11 of the general control unit 10 of the variation in the user's physiological condition. In addition, the physiological and psychological information analyzing unit 44 determines whether or not there exist irregular pulses and whether or not there occur irregularities in the waveform of the electrocardiogram, and then estimates a variation in the user's physiological condition accompanied by the load of the physical exercise imposed on the user. After that, the physiological and psychological information analyzing unit 44 informs the control computer 11 of the general control unit 10 of the variation in the user's physiological condition, particularly, information used for the control computer to determine whether or not it continues to provide the rehabilitation physical exercise for the user. Furthermore, the physiological and psychological information analyzing unit 44 can estimate the user's physiological condition from a combination of the above characteristic quantities and furnish the information about the user's physiological condition to the control computer 11 of the general control unit 10. For example, it can estimate that the user reduces user's concentration, or the user becomes bored from a decrease in the regularity of respiration and increases in variations in the heartbeat and blood pressure. Variations in the heart rate and blood pressure can be caused by either a variation in the load of the physical exercise or a variation in the user's psychological condition. Therefore, by measuring the amount of oxygen consumed, the amounts of increases in the heart rate and blood pressure caused by only the variation in the load of the physical exercise can be estimated. Accordingly, the control computer can determine that the differences between the total amounts of increases in the heart rate and blood pressure and the estimated amounts of increases due to a variation in the load of the physical exercise are caused by a variation in the user's psychological condition, and therefore it can carry out a fine control operation according to such the information.

Instead of automatically estimating the user's physiological condition by using an analyzing algorithm so as to automatically control the load of the physical exercise, the bedside wellness system can be adapted to measure an electrocardiogram, the blood pressure, and respiration of the user who lies in bed by means of the electrocardiograph 41, the blood pressure meter 42, and the respiration meter 43, and display the measured values and the waveform of the electrocardiogram, and characteristic quantities calculated on the display so that an operator such as a doctor or a rehabilitation doctor can monitor them displayed on the display and give the general control unit 10 an instruction to set the load of the physical exercise to be provided for the user who lies in bed to a desired value. Thus, the variant of this embodiment makes it possible to provide an optimum load of the physical exercise for a user who lies in bed on the basis of a judgment of a doctor or a rehabilitation doctor.

As previously explained, the bedside wellness system according to the first embodiment can create a wind the velocity of which can be expected from the scene, which is shown by an image of the virtual reality environment provided, such as the shaking of trees or rustlings of leaves, or the walking speed of a user who lies in bed, and actually blow the wind toward the user. Furthermore, the bedside wellness system can feed a variety of fragrances which correspond to the situation to the user. The bedside wellness system can incorporate the resistance of the wind which can be estimated from the image on-screen into the actual load of the physical exercise by means of the rehabilitation unit 30. In addition, the bedside wellness system can provide a vibration which corresponds to the surface condition of a road on which the user is stepping in the virtual reality environment so as to cause the user to feel as if the user steps on something. Accordingly, the bedside wellness system can add to the realism. Furthermore, the bedside wellness system can change the contents of the virtual reality environment according to the physiological condition of the user who lies in bed. For example, it can replace the virtual reality environment with another one having gentle contents which cause the user to become calm, when the user is in an excited state. On the contrary, when the user becomes bored, the bedside wellness system replaces the virtual reality environment with another one having exciting contents. Therefore, the bedside wellness system of this embodiment can easily cause the user to motivate himself or herself for rehabilitation, and can cause the user such as a patient who cannot do a physical exercise at the patient's will to do the physical exercise by forcefully helping the patient to do the physical exercise. That is, it can cause a bedridden patient to do a suitable rehabilitation physical exercise. In addition, the bedside wellness system can prevent a user from getting himself or herself absorbed in an artificial environment created by the bedside wellness system to excess and then doing a physical exercise to excess. Thus, the bedside wellness system of this embodiment can not only provide a person of health or a patient who is tolerably restored in health with a physical exercise to improve the person's health and physical strength, but also provide a patient that has no alternative but to be confined to bed with an early rehabilitation exercise which the patient does in the presence of a doctor, or according to instructions of a doctor, so as to encourage the patient to do early rising and prevent the patient from atrophying with disuse.

Figure 2:
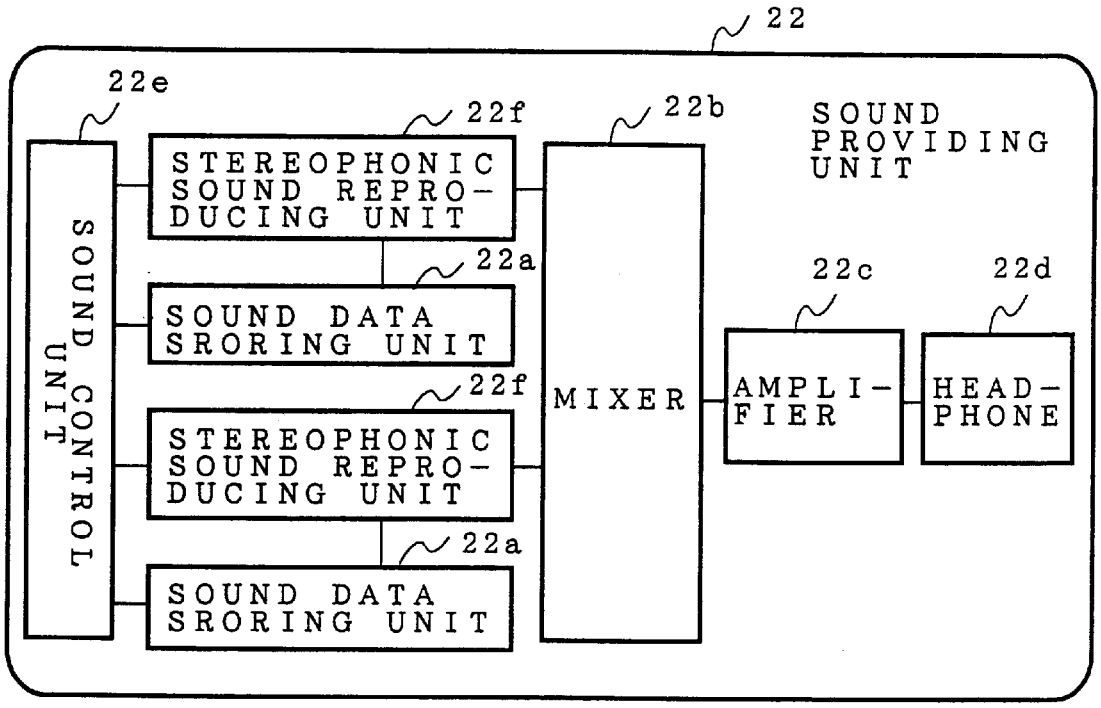
FIG. 2 is a block diagram showing an example of a sound providing unit of a bedside wellness system according to a second embodiment of the present invention.

Referring next to FIG. 2, there is illustrated a block diagram showing the sound providing unit of a bedside wellness system of a second embodiment of the present invention. The same components as those shown in FIG. 1 of the bed wellness system of the first embodiment are designated by the same reference numerals, and the description about the components will be omitted hereinafter. The bedside wellness system of the second embodiment is adapted to create and provide a stereophonic sound, which can create a three-dimensional effect of auditory perspective, for a user according to an image on-screen by mixing environmental sounds such as tree's rustlings and sounds which are emitted from a plurality of sound sources, respectively. In FIG. 2, reference numeral **22*f* denotes a stereophonic sound reproducing unit for pinpointing the location of one of the sound sources in the sound space of the virtual reality environment by using a head reiiated transfer function (HRTF) which is a transfer function of the frequency and power of a sound travelling from the sound source to the user's eardrum, so as to reproduce a stereophonic sound field in the virtual reality environment to be provided, so that the user can feel as if the sound is emitted out of the sound source located in the sound space of the virtual reality environment. There are provided a plurality of stereophonic sound reproducing units 22*f*, the number of which is equal to the number of the plurality of sound sources. In the example shown in FIG. 2, there are provided two HRTF reproducing units 22*f*. The sound providing unit 22 of the second embodiment is provided with the two stereophonic sound reproducing units 22*f*, mixer 22*b*, amplifier 22*c*, headphone 22*d*, two sound data storing units 22*a*, the number of which is equal to the number of the plural sound sources, and sound control unit 22*e* for controlling the operation of the sound providing unit 22**.

In operation, when the control computer 11 of the general control unit 10 shown in FIG. 1 furnishes information about the three-dimensional positions of the plurality of sound sources and information about the plurality of sound sources, which correspond to an image displayed by the image display unit 21, to the sound control unit **22*e*, the sound control unit 22*e* reads sound data from the plurality of sound data storing units 22*a* according to the above information furnished thereto. When the contents of the virtual reality environment include a scene in which a small bird is flying while twittering, sound data about the phrase of a bird's twitterings which can be replayed in synchronization with the image information about the bird flying are stored in one of the plural sound data storing units 22*a*. In this case, the twitterings of the small bird is not identified as a sound included in environmental sounds, but it is identified as a sound which is emitted out of one sound source. The position of the small bird, the dimensions of the vicinity of the bird which can reflect a sound which the bird makes such as the bird's twittering and which a human being can hear, the reflectivity of a sound against the vicinity of the bird, and the timing of the twitterings are also stored in the first data base 12 in the general control unit 10 shown in FIG. 1. The sound control unit 22***e* furnishes the sound data which it has read from the plurality of sound data storing units 22*a,* the information about three-dimensional positions of the plurality of sound sources, and the information about the sound field from the control computer 11 of the general control unit 10 to the plurality of stereophonic sound reproducing units 22*f*. The HRTF which is a transfer function of the frequency and power of a sound travelling from each of the plural sound sources to the user's eardrum serves to enable a human being to pinpoint the position of each of the sound sources in a sound image. That is, each of the stereophonic sound reproducing units 22*f* can pinpoint location of the corresponding sound source in the sound space created by the headphone 22 according to the user's corresponding HRTF. These reproduced sounds are mixed with each other and are further mixed with environmental sounds when needed, and then the mixed sounds are amplified by the amplifier 22*c*. Finally, the headphone 22*d* offers a stereophonic sound including the mixed sounds.

In the above example shown in FIG. 2, the bedside wellness system is provided with the two stereophonic sound reproducing units 22*f* and the two sound data storing units 22*a,* so that it enables the sound providing unit 22 to pinpoint the locations of two sound sources in the sound space. In order to control sounds which are emitted from three or more sound sources, the bedside wellness system of this embodiment can be provided with a plurality of stereophonic sound reproducing units 22*f* and a plurality of sound data storing units 22*a,* the numbers of which are equal to the number of the sound sources.

As previously explained, when the contents of the virtual reality environment provided are about a situation in which the user has forest bathing in a virtual forest, the bedside wellness system of the second embodiment can provide a stereophonic sound including, for example, twitterings of a small bird flying around and tree's rustlings caused by a wind blowing which can be identified as sound sources, with the locations of the sound sources pinpointed in the sound space of the virtual reality environment, for a user who lies in bed. Therefore, the bedside wellness system can add to the realism, thereby encouraging the user to motivate himself and herself for rehabilitation, and making the user feel more physically relaxed. Furthermore, since the bedside wellness system can reproduce a stereophonic sound field by means of the headphone 22 according to user's own HRTFs so as to enable the user to pinpoint the locations of sound sources, the realism with respect to the sound, which is added by the bedside wellness system, is extremely sophisticated.

Figure 3:
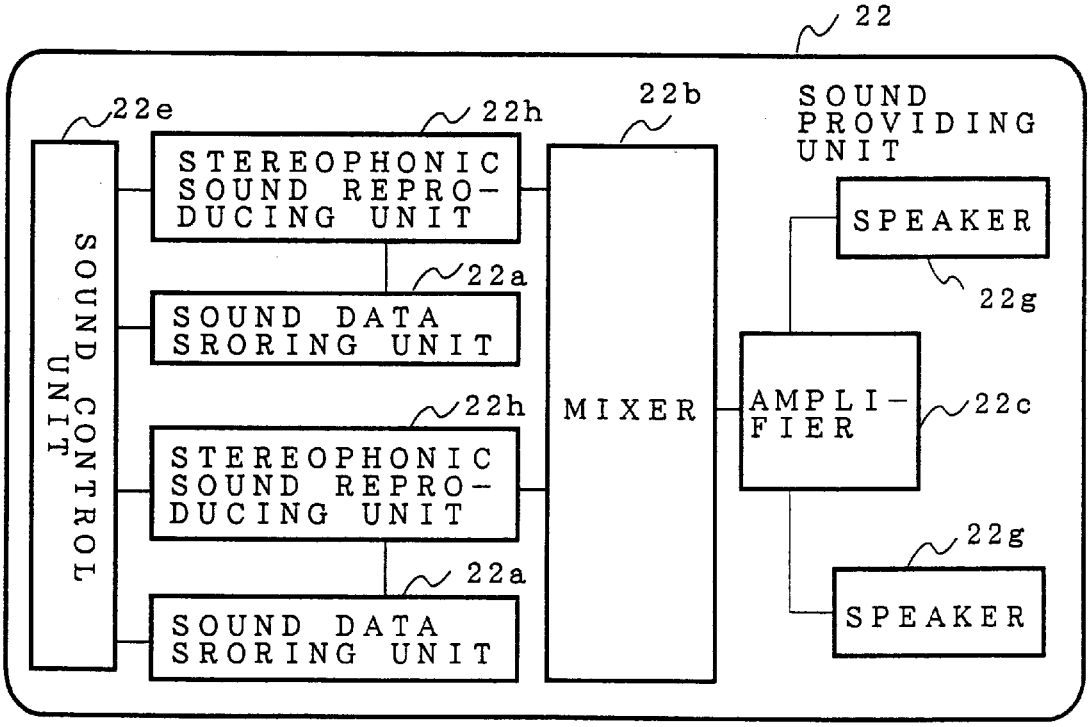
FIG. 3 is a block diagram showing another example of the sound providing unit of the bedside wellness system according to the second embodiment.

Instead of reproducing a stereophonic sound field by using the headphone 22*d* as mentioned above, the bedside wellness system can reproduce a sound field in three space by using at least a pair of speakers. Referring next to FIG. 3, there is illustrated a block diagram of a sound providing unit 22 according to such the variant of the embodiment. The headphone 22*d* shown in FIG. 2 is replaced by a pair of speakers 22*g,* and the plurality of stereophonic sound reproducing units 22*f* each using a HRTF are replaced by a plurality of stereophonic sound reproducing units 22*h* each for pinpointing the location of a corresponding sound source in the sound space of the virtual reality environment so as to reproduce a stereophonic sound using the pair of speakers. The other components of the sound providing unit are the same as those of the sound providing unit equipped with the headphone 22*d* shown in FIG. 2. In the case of the sound providing unit 22 equipped with the pair of speakers shown in FIG. 3, each of the plurality of stereophonic sound reproducing units 22*h* pinpoints the location of a corresponding sound source in the sound space of the virtual reality environment so as to reproduce a stereophonic sound. The reproduced sounds are mixed with each other by the mixer 22*b* and are further mixed with environmental sounds, and then are amplified by the amplifier 22*c*. After that, the mixed and amplified sounds are emitted out of the pair of speakers 22*g*. In order to control sounds which are emitted from three or more sound sources, the bedside wellness system of this variant can be provided with a plurality of stereophonic sound reproducing units 22*h* and a plurality of sound data storing units 22*a,* the numbers of which are equal to the number of the sound sources, like the aforementioned bed wellness system including the plurality of stereophonic sound reproducing units 22*f*.

Accordingly, since the bedside wellness system of this variant can provide a stereophonic sound including sounds which are emitted from respective sound sources according to an image of the virtual reality environment for a space surrounding a user who lies in bed, while pinpointing the locations of the sound sources in three space, the bedside wellness system can add a sense of sophisticated realism while eliminating the inconvenience of mounting the headphone 22*d* on the user's head. Therefore, the bedside wellness system can encourage the user to motivate himself and herself for rehabilitation, and make the user feel more physically relaxed.

If environmental sounds can be divided into sounds emitted out of a plurality of sound sources, the sounds can also be provided stereophonically by using a plurality of corresponding stereophonic sound reproducing units as mentioned above.

Figure 4:
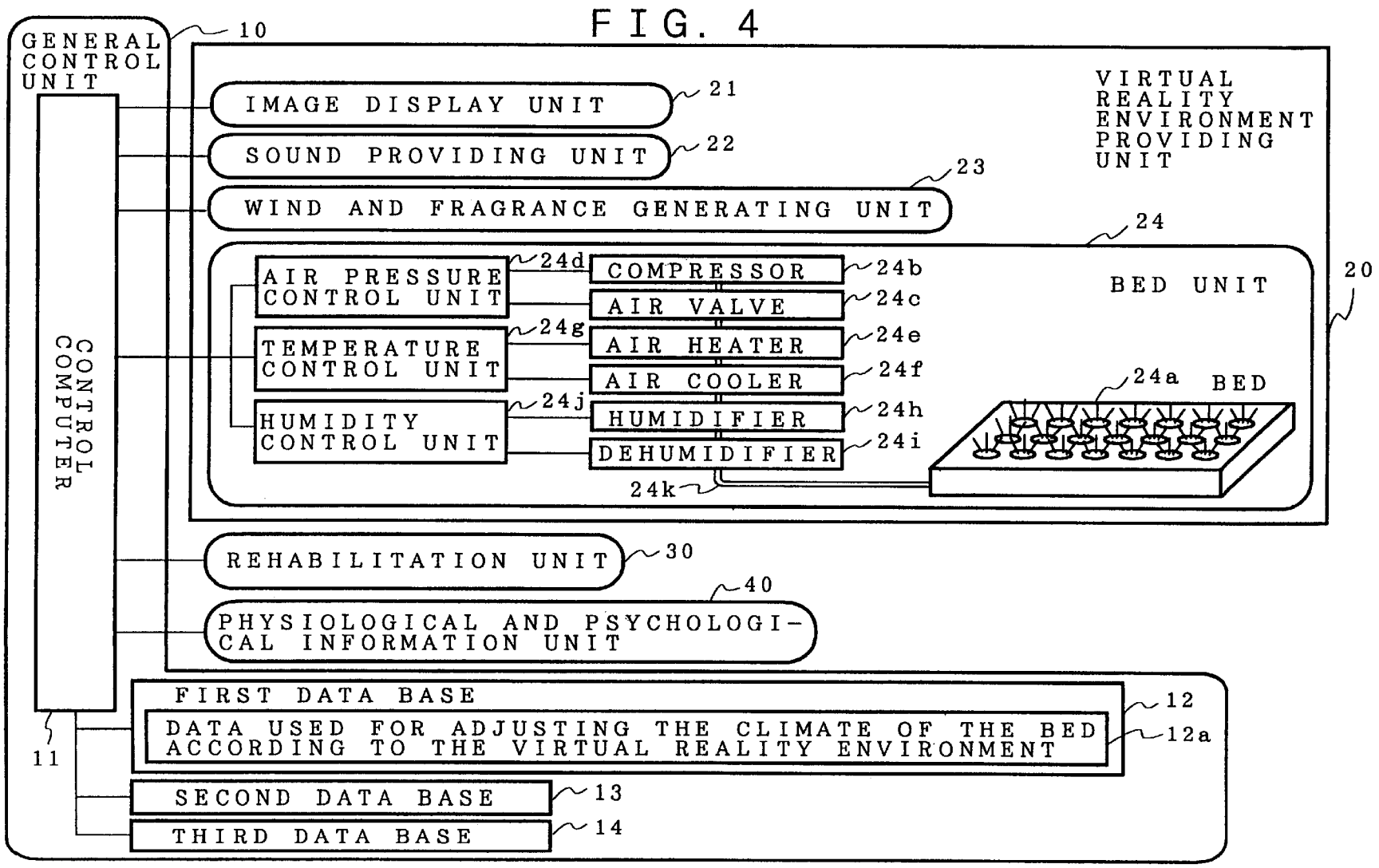
FIG. 4 is a block diagram of a bedside wellness system according to a third embodiment of the present invention.

Referring next to FIG. 4, there is illustrated a block diagram showing the structure of a bedside wellness system of a third embodiment of the present invention. The same components as those shown in FIG. 1 of the wellness system of the first embodiment are designated by the same reference numerals, and the description about the components will be omitted hereinafter. The bedside wellness system of the third embodiment is provided with a bed unit disposed in the virtual reality environment providing unit 20, for adjusting the climate (i.e., bed conditions) of a bed in which the user lies, such as its hardness, and the temperature and humidity of its inside. In FIG. 4, reference numeral 24 denotes the bed unit disposed in the virtual reality environment providing unit 20, for adjusting the climate of the inside of the bed. Furthermore, reference numeral 12*a* denotes data, which were prestored in the first data base 12 of the general control unit 10, and which are referred by the bed unit 24 when it adjusts the climate of the inside of the bed, such as its hardness, and the temperature and moisture of its inside, according to an image of the virtual reality environment to be provided by the display 21*c* of the image display unit 21.

The bed unit 24 is provided with the bed 24*a* divided into a plurality of small sections and provided with a plurality of blowing outlets each formed on the upper surface of each of the plurality of small sections for blowing air, a compressor 24*b* for feeding air so as to inject it into each of the plurality of small sections of the bed 24*a,* an air valve 24*c* for adjusting the amount of the air supplied by the compressor 24*b,* and an air pressure control unit 24*d* for controlling the compressor 24*b* and air valve 24*c*. These compressor 24*b,* air valve 23*c,* and air pressure control unit 24*d* construct a hardness adjusting unit for adjusting the hardness of the bed by controlling the pressure of each of the plurality of small sections of the bed 24*a*. The bed unit 24 further comprises an air heater 24*e* for increasing the temperature of the air passing through the air valve 24*c,* an air cooler 24*f* for decreasing the temperature of the air passing through the air valve 24*c,* and an air temperature control unit 24*g* for controlling the air heater 24*e* and air cooler 24*f*. These air heater 24*e,* air cooler 24*f,* and air temperature control unit 24*g* construct a bed temperature control unit for adjusting the temperature of the inside of the bed by controlling the temperature of the air blowing out of the plurality of blowing outlets of the plurality of small sections of the bed 24*a*. In addition, the bed unit 24 further includes a humidifier 24*h* for humidifying the air, the temperature of which has been adjusted by the air heater 24*e* or air cooler 24*f,* a dehumidifier 24*i* for dehumidifying the air, the temperature of which has been adjusted by the air heater 24*e* or air cooler 24*f,* a humidity control unit 24*j* for controlling the humidifier 24*h* and dehumidifier 24*i*. These humidifier 24*h,* dehumidifier 24*i,* and humidity control unit 24*j* construct a humidity adjusting unit for adjusting the humidity of the inside of the bed by controlling the humidity of the air blowing out of the plurality of blowing outlets of the plurality of small sections of the bed 24*a*. Furthermore, there is provided a pipe 24*k* for supplying the air fed by the compressor 24*b* to each of the plurality of small sections of the bed 24*a* by way of the air valve 24*c,* air heater 24*e,* air cooler 24*f,* humidifier 24*h,* and dehumidifier 24*i*.

In operation, the control computer 11 of the general control unit 10 controls and enables the image display unit 21 of the virtual reality environment providing unit 20 to display an image of a virtual reality environment according to its predetermined contents. Simultaneously, the control computer 11 of the general control unit 10 reads information about the climate of the inside of the bed which corresponds to the image provided from an area in the first data base 12 for storing the data 12*a* about how to control the climate of the inside of the bed according to an image to be provided, and then controls the air pressure control unit 24*d,* temperature control unit 24*g,* and humidity control unit 24*j* according to the information so that the climate of the inside of the bed matches or corresponds to the image displayed.

As previously explained, the bed 24*a* is divided into the plurality of small sections each having one blowing outlet, through which the air is blown, formed on the upper surface thereof. Each of the plurality of small sections is connected to the compressor 24*b* by way of the pipe 24*k*. The air valve 24*c,* air heater 24*e,* air cooler 24*f,* humidifier 24*h,* and dehumidifier 24*i* are connected between each of the plurality of small sections of the bed 24*a* and the compressor 24*b*. For simplicity, only one circuit including the air valve 24*c,* air heater 24*e,* air cooler 24*f,* humidifier 24*h,* and dehumidifier 24*i* is illustrated in FIG. 4. The bedside wellness system is actually provided with a plurality of circuits each including the air valve 24*c,* air heater 24*e,* air cooler 24*f,* humidifier 24*h,* and dehumidifier 24*i* to be able to control the pressure, temperature, and humidity of the air of each of the plurality of small sections of the bed independently. The air pressure control unit 24*d* controls the closing and opening of the air valve 24*c* and operation of the compressor 24*b* according to instructions from the control computer 11 of the general control unit 10. Accordingly, the control computer can adjust the hardness of the bed by controlling the air pressure of each of the plurality of small sections and simultaneously causes the air to blow out of each of the plurality of blowing outlets formed on the upper surface of the bed 24*a*. On the other hand, the temperature control unit 24*g* controls the air heater 24*e* and air cooler 24*f* according to instructions from the control computer 11 of the general control unit 10 so as to adjust the temperature of the air fed by the compressor 24*b*. Similarly, the humidity control unit 24*j* controls the humidifier 24*h* and dehumidifier 24*i* according to instructions from the control computer 11 of the general control unit 10 so as to adjust the humidity of the air fed by the compressor 24*b*. Thus, the bedside wellness system of this embodiment can adjust the hardness of the bed, and the climate of the inside of the bed such as the temperature and humidity of the inside of the bed, according to an image of the virtual reality environment provided by the image display unit 21.

As previously mentioned, the bedside wellness system according to the third embodiment makes it possible to provide a user who lies in bed with an image of a virtual reality environment according to its predetermined contents, and adjust the climate of the inside of the bed so that it matches or corresponds to the image. Thereby, the bedside wellness system can provide a complex virtual reality environment and hence add to the realism.

The hardness of the bed can be adjusted by using water or gel liquid having good hot insulation capability and adjusting the pressure of the liquid, instead of adjusting the air pressure of the bed 24*a*. Alternatively, adjusting the pressure of a mat which can be placed under the user who lies in bed can be carried out in order to adjust the hardness of the bed 24*a*. Similarly, the adjustment of the temperature of the inside of the bed 24*a* or a predetermined position of the bed by the bed temperature adjusting unit can be carried out by adjusting the temperature of the water or gel liquid, instead of adjusting the temperature of the air. Alternatively, the bed temperature adjusting unit of the bedside wellness system can be adapted to adjust the temperature of a predetermined position of a mat which can be placed under the user who lies in bed. Furthermore, the humidity control unit of the bedside wellness system can be adapted to blow air out of the mat which is placed under the user who lies in bed, instead of the bed 24*a,* in order to adjust the humidity of the inside of the bed.

Figure 5:
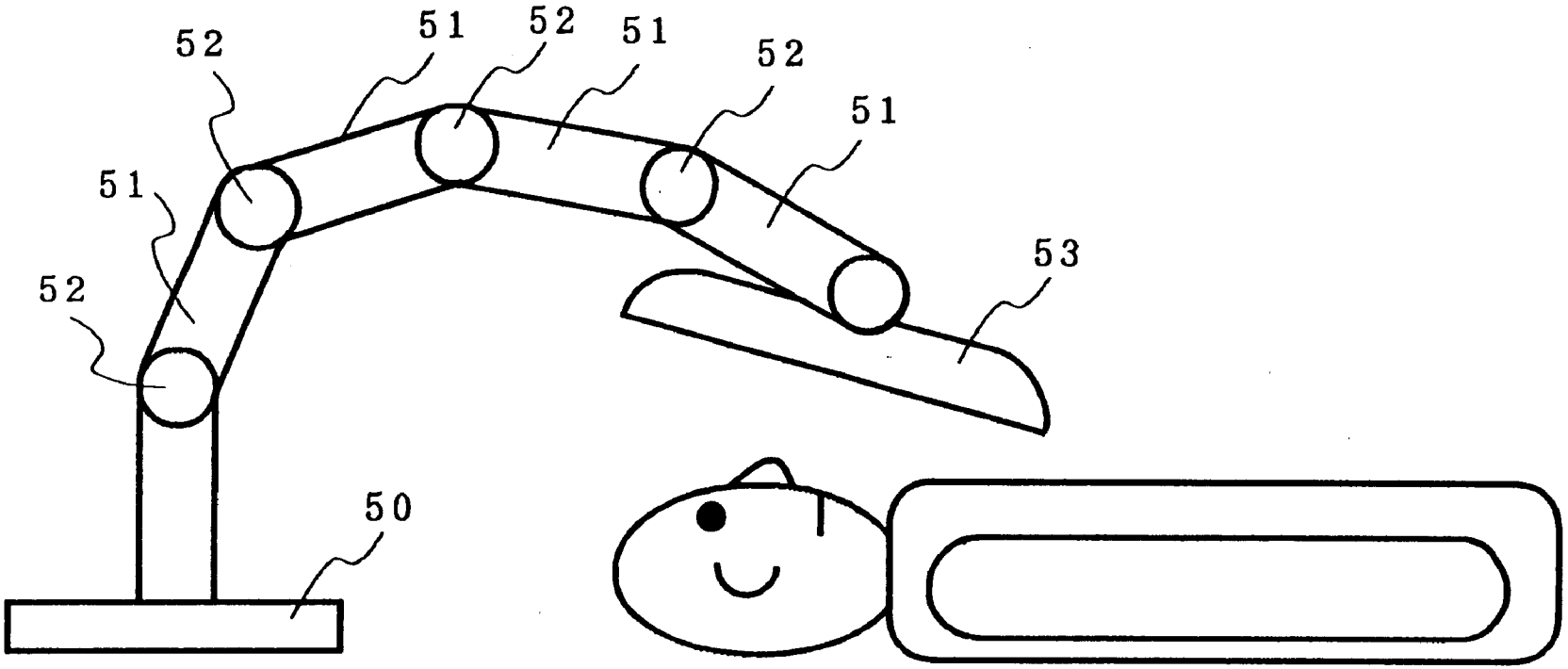
FIG. 5 is a schematic diagram showing main components of an image display unit of a bedside wellness system according to a fourth embodiment of the present invention.

Referring next to FIG. 5, there is illustrated a block diagram showing main components of the image display unit of a bedside wellness system of a fourth embodiment of the present invention. The bedside wellness system of this embodiment is provided with the same components as those shown in FIG. 1 of the bedside wellness system of the first embodiment, and therefore the description about the components will be omitted hereinafter. The image display unit of the bedside wellness system of the fourth embodiment is provided with a positioning unit for movably supporting the image display and positioning it at a desired position. In FIG. 5, reference numeral 50 denotes a base, 51 denotes an arm, 52 denotes a joint, and 53 denotes the image display. The base 50 is adapted to support the positioning unit comprised of the plurality of arms 51 and the plurality of joints 52, and the image display 53 so that they don't fall. Each of the plurality of arms 51 is constructed of a rigid body shaped like a rod. The plurality of joints 52 connect the arm 51 secured to the base 50 to the arm 51 adjacent to the former arm so that the former arm rotates about the corresponding joint, connect the adjacent arms 51, except the arm secured to the base, to each other so that both of the arms rotate about the corresponding joint, and connect the remaining one of the arms 51 to the image display 53 so that the image display rotates about the corresponding joint, respectively, while each of the plurality of joints has predetermined friction which acts on two adjacent components connected by each of the plurality of joints. Thus, the plurality of joints serve as the positioning unit to movably support the image display 53 and position it at a desired position in cooperation with the plurality of arms 51. A light-weight liquid crystal display or a plasma display can be used as the image display 53.

In operation, a user who lies in bed can move the image display 53 by hand so as to position it near by the user's face and in front of the user. Since the image display 53 is supported, by way of the positioning unit comprised of the plurality of arms 51 and the plurality of joints 52, by the base 50 and there exists predetermined friction in each of the plurality of joints 52, the user can position the image display 53 in the place where it has been moved by only letting go the user's hold of the image display. When the user changes a user's posture, for example, when the user turns over in bed, the user can easily adjust and change the position of the image display 53 by only doing the similar operation, i.e., holding and moving the image display 53 to a desired position. Thus, the bedside wellness system of this embodiment makes it possible for the user to easily position the image display 53 near by the user's face and hence watch an image of the virtual reality environment provided at an easy-to-see distance from the display and an easy-to-see angle.

Figure 6:
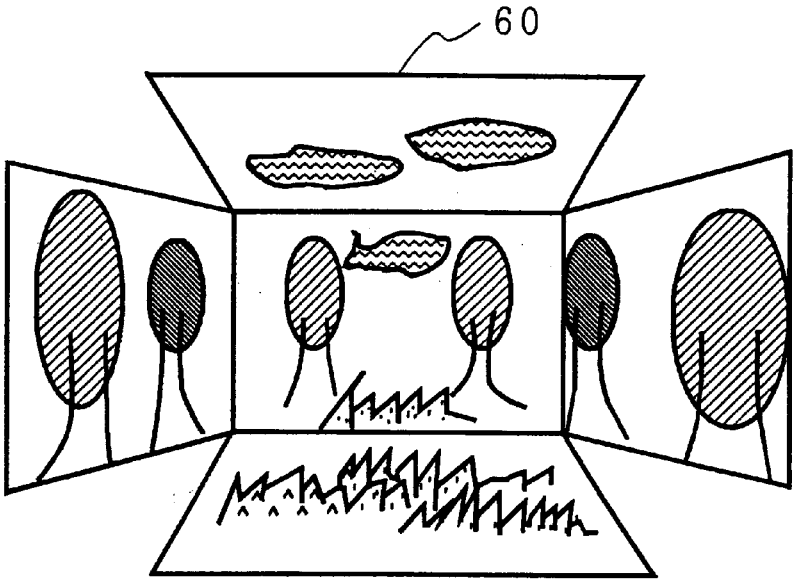
FIG. 6 is a schematic diagram showing an example of the screen of an image display of a bedside wellness system according to a fifth embodiment of the present invention.

Referring next to FIG. 6, there is illustrated a schematic view showing an example of the screen of the image display of a bedside wellness system of a fifth embodiment of the present invention. The bedside wellness system of this embodiment is provided with the same components as those shown in FIG. 1 of the bedside wellness system of the first embodiment, and therefore the description about the components will be omitted hereinafter. The image display of the image display unit of the bedside wellness system of the fifth embodiment has a screen which is so shaped as to surround the face of a user who lies in bed. In FIG. 6, reference numeral 60 denotes a flat liquid crystal device, the screen of which is shaped like a planar face of the inner closed surface of a polyhedron. The screen of the display 21*c* is constructed of five flat liquid crystal devices 60, as shown in FIG. 6.

In operation, the display 21*c*, the screen of which is shaped like a part of the inner closed surface of a polyhedron, is so positioned as to surround the face of a user who lies in bed. Then, the bedside wellness system displays an image of the virtual reality environment on the display 21*c* according to its predetermined contents. The image is divided into a plurality of parts, the number of which is equal to the number of the plurality of flat liquid crystal devices 60 which construct the display 21*c*, and the plurality of divided parts of the image are displayed on the respective screens of the flat liquid crystal devices by means of a plurality of image display systems, the number of which is equal to the number of the plurality of flat liquid crystal devices 60. The plurality of parts of the image are modified according to a method of taking or creating the image so that there is not a joint to be seen on the screen, that is, the image can be seen seamlessly. To be more specific, the plurality of parts of the image are processed in consideration of the boundaries between two adjacent parts of the image and the angles between the screens of two adjacent flat liquid crystal devices so that the image which constructs the virtual reality environment can be seen seamlessly. Even when creating an image which constructs a virtual reality environment by using a computer graphics program, the image is created in consideration of the boundaries between two adjacent parts of the image and the angles between the screens of two adjacent flat liquid crystal devices. Thus, the bedside wellness system of this embodiment can provide a user who lies in bed with an image of a virtual reality environment which does not make the user have a feeling of physical disorder.

Figure 7:
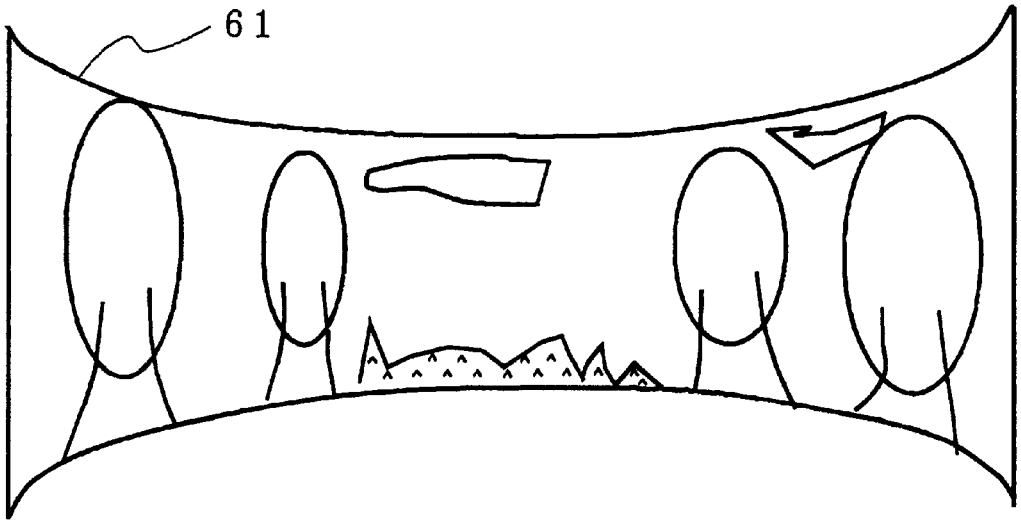
FIG. 7 is a schematic diagram showing another example of the screen of the image display of the bedside wellness system according to the fifth embodiment of the present invention.
Figure 8:
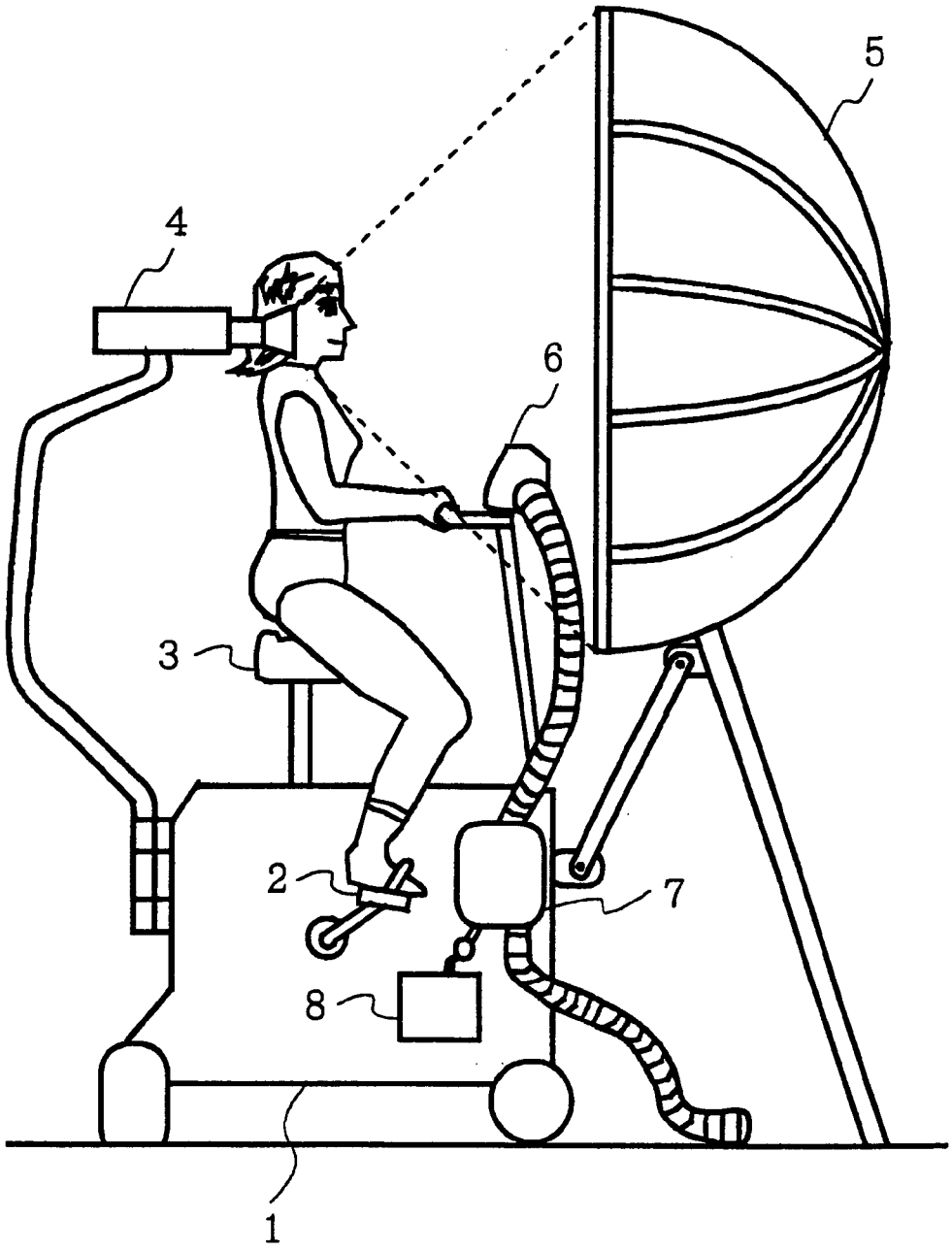
FIG. 8 (PRIOR ART)
FIG. 8 is a schematic diagram of a prior art wellness system.

Referring next to FIG. 7, there is illustrated a schematic view showing another example of the screen of the image display of a bedside wellness system of the fifth embodiment of the present invention. In the figure, reference numeral 61 denotes a flexible liquid crystal device, the screen of which is so shaped like a part of a concave curved surface as to surround the face of a user who lies in bed. The display 21*c* of this variant is constructed of the flexible liquid crystal device 61, as shown in FIG. 7.

The display 21*c*, the screen of which is thus shaped like a part of a concave curved surface, is so positioned as to surround the face of a user who lies in bed. Then, the bedside wellness system displays an image of the virtual reality environment on the concave curved screen of the display 21*c* according to its predetermined contents. The image data has been transformed according to a method of taking the image and the shape of the curved display screen in advance of storing the image data. When creating an image which constructs a virtual reality environment by using a computer graphics program, the image is created in consideration of the shape of the curved display screen.

As previously explained, the bedside wellness system according to the fifth embodiment can provide a user who lies in bed with an image of a virtual reality environment in the face of the user according to the predetermined contents of the virtual reality environment, by means of the display 21*c* which is so shaped as to surround the user's face. In the example shown in FIG. 6, the user can take wide fields of view in the horizontal and vertical directions. On the other hand, in the example shown in FIG. 7, the user can take a wide field of view in the horizontal direction. Therefore, the bedside wellness system of this embodiment can cause the user to have a strong feeling of getting himself or herself absorbed in a virtual reality environment created by the bedside wellness system. Accordingly, the introduction of such the method of providing an image of this embodiment makes it possible to provide a virtual reality environment which adds to the realism, i.e., causes the user to feel as if the user stays in the virtual reality environment, thereby causing the user to refresh himself or herself more effectively, and causing the user to motivate himself or herself for rehabilitation more effectively.

As previously mentioned, the present invention offers the following advantages.

In accordance with a preferred embodiment of the present invention, the bedside wellness system is adapted to control the virtual reality environment provided by the virtual reality environment providing unit according to a movement of the user measured by the exercise load providing unit. Accordingly, the virtual reality environment provided by the virtual reality environment providing unit can be varied realistically according to the physical exercise which the user who lies in bed is doing. Thus, the bedside wellness system can add a sense of realism enough to easily cause a patient who lies in bed to motivate himself or herself for rehabilitation. Furthermore, the bedside wellness system of this embodiment can cause a patient who has no alternative but to be confined to bed to do an early rehabilitation exercise, so as to encourage the patient to do early rising, and prevent the patient from atrophying with disuse.

In accordance with another preferred embodiment of the present invention, the bedside wellness system is adapted to control the contents of the virtual reality environment provided by the virtual reality environment providing unit according to the user's psychological condition estimated by the physiological and psychological condition evaluating unit. The bedside wellness system can replace the virtual reality environment with another one having gentle contents which cause the user to become calm, when the user is in an excited state. On the contrary, when the user becomes bored, the bedside wellness system can replace the virtual reality environment with another one having exciting contents. Therefore, the bedside wellness system of this embodiment can easily cause a user to motivate himself or herself for rehabilitation.

In accordance with another preferred embodiment of the present invention, the bedside wellness system is adapted to control the load of the physical exercise provided by the exercise load providing unit according to the user's physiological condition estimated by the physiological and psychological condition evaluating unit. Accordingly, the bedside wellness system of this embodiment can cause the user such as a patient who cannot do a physical exercise at the patient's will to do the physical exercise by forcefully helping the patient to do the physical exercise. In addition, the bedside wellness system of this embodiment can prevent a user who lies in bed from getting himself or herself absorbed in an artificial environment created by the bedside wellness system to excess and then doing a physical exercise to excess. Thus, the bedside wellness system can provide an appropriate rehabilitation physical exercise for a bedridden patient, so as to encourage the patient to do early rising and prevent the patient from atrophying with disuse.

In accordance with another preferred embodiment of the present invention, the bedside wellness system is adapted to display physiological information about the user who lies in bed, which is estimated by the physiological and psychological condition evaluating unit, and receive an instruction input by an operator, who has determined to provide the instruction according to the physiological information displayed, so as to control the load of the physical exercise provided by the exercise load providing unit. Accordingly, an operator such as a doctor or a rehabilitation doctor can monitor and evaluate the user's physiological condition displayed on the display and then provide an instruction to set the load of the physical exercise to be provided by the exercise load providing unit to a desired value. Thus, the bedside wellness system of this embodiment makes it possible to adjust the load of the physical exercise finely so that it is more suitable for the user.

In accordance with another preferred embodiment of the present invention, the virtual reality environment providing unit can stereophonically provide the user with a sound which is emitted from at least one sound source according to an image of the virtual reality environment to be provided. For example, according to an image of a path in a forest, the bedside wellness system can pinpoint the locations of twitterings of a small bird that flits around and tree's rustlings caused by a wind blowing stereophonically so as to provide the sounds for the user who lies in bed. Thus, the bedside wellness system can add a sense of sophisticated realism, thereby encouraging the user to motivate himself and herself for rehabilitation, and making the user feel more physically relaxed.

In accordance with another preferred embodiment of the present invention, the sound providing unit includes a stereophonic sound reproducing unit for pinpointing the locations of sound sources in the sound space of the virtual reality environment from information about the three-dimensional positions of the sound sources so as to reproduce a stereophonic sound field of the virtual reality environment on the basis of sound data on the sound sources and the three-dimensional position information, by using head reiiated transfer functions, the number of which is equal to the number of the sound sources. Furthermore, the bedside wellness system can provide the stereophonic sound reproduced for the user who lies in bed by means of a headphone. Thus, a stereophonic sound field can be reproduced according to the user's own HRTFs by means of the headphone. The realism which is added by the bedside wellness system of this embodiment is extremely sophisticated with respect to the sound. Furthermore, the bedside wellness system can encourage the user to motivate himself and herself for rehabilitation, and make the user feel more physically relaxed.

In accordance with another preferred embodiment of the present invention, the sound providing unit includes a stereophonic sound reproducing unit for pinpointing the locations of sound sources in the sound space of the virtual reality environment from information about the three-dimensional positions of the sound sources so as to reproduce a stereophonic sound field of the virtual reality environment on the basis of sound data on the sound sources and the three-dimensional position information. Furthermore, the bedside wellness system can provide the stereophonic sound reproduced for the user who lies in bed by means of a pair of speakers. Thus, the bedside wellness system can add a sense of sophisticated realism while eliminating the inconvenience of mounting the headphone on the user's head. Furthermore, the bedside wellness system can encourage the user to motivate himself and herself for rehabilitation, and make the user feel more physically relaxed.

In accordance with another preferred embodiment of the present invention, the virtual reality environment providing unit includes a unit for adjusting the hardness of a bed on which the user lies, a unit for adjusting the temperature of the inside of the bed, and a unit for adjusting the humidity of the inside of the bed. Furthermore, the virtual reality environment providing unit can control the hardness adjusting unit, the temperature adjusting unit, and the humidity adjusting unit according to an image of the virtual reality environment to be provided. Accordingly, the bedside wellness system according to this embodiment makes it possible to provide a user who lies in bed with an image of a virtual reality environment according to its predetermined contents, and adjust the climate of the inside of the bed so that it matches or corresponds to the image. Thereby, the bedside wellness system can provide a complex virtual reality environment and hence add to the realism.

In accordance with another preferred embodiment, the virtual reality environment providing unit is adapted to movably support an image display unit for displaying an image of the virtual reality environment, and position it at a desired position. Thus, the bedside wellness system of this embodiment makes it possible for the user who lies in bed to easily position the image display unit near by the user's face and hence watch an image of the virtual reality environment provided at an easy-to-see distance from the image display unit and an easy-to-see angle.

In accordance with another preferred embodiment of the present invention, the virtual reality environment providing unit includes an image display having a screen which is so shaped as to surround the face of the user who lies in bed, and on which an image of the virtual reality environment is displayed. Therefore, the bedside wellness system of this embodiment makes it possible to provide a virtual reality environment which adds to the realism, thereby causing the user to refresh himself or herself more effectively, and causing the user to motivate himself or herself for rehabilitation more effectively.

Many widely different embodiments of the present invention may be constructed without departing from the spirit and scope of the present invention. It should be understood that the present invention is not limited to the specific embodiments described in the specification, except as defined in the appended claims.

What is claimed is:

1. A bedside wellness system comprising:

an exercise load providing means for providing a load of a physical exercise for a user lying in a bed, and for measuring movements of the user performing the physical exercise;

a virtual reality environment providing means for providing the user with a virtual reality environment which causes the user's plural human senses to work according to the contents of the provided virtual reality environment;

a physiological and psychological condition evaluating means for acquiring information about the user's condition so as to evaluate the user's physiological and psychological conditions; and a control means for controlling the virtual reality environment provided by said virtual reality environment providing means according to the user's movements measured by said exercise load providing means, said control means further controlling at least one of the virtual reality environment provided by said virtual reality environment providing means and the load of the physical exercise provided by said exercise load providing means in accordance with the user's physiological and psychological conditions evaluated by said physiological and psychological condition evaluating means.

2. The bedside wellness system according to claim 1, wherein said virtual reality environment providing means includes a sound providing means which can stereophonically provide the user with a sound which is emitted out of at least one sound source according to an image of the virtual reality environment to be provided by said virtual reality environment providing means.

3. The bedside wellness system according to claim 2, wherein said control means includes a means for furnishing sound source information about at least a sound source to be located in the virtual reality environment to be provided by said virtual reality environment providing means and three-dimensional position information about a three-dimensional position of the sound source to said sound providing means, and wherein said sound providing means includes a sound data storing means for storing data about a sound which the sound source emits, a sound control means for reading sound data about the sound source from said sound data storing means on the basis of the sound source information and the three-dimensional position information so as to furnish the sound data, a stereophonic sound reproducing means for pinpointing the location of the sound source in a sound space of the virtual reality environment on the basis of the three-dimensional position information from said control means so as to reproduce a stereophonic sound field of the virtual reality environment from the sound data from said sound control means so that the user can feel as if the sound is emitted out of a corresponding position of the sound source in the sound space of the virtual reality environment, and a sound generating means for providing the stereophonic sound field reproduced by said stereophonic sound reproducing means for the user who lies in bed.

4. The bedside wellness system according to claim 3, wherein said sound generating means includes a headphone, and wherein said stereophonic sound reproducing means reproduces the stereophonic sound field of the virtual reality environment by using a head reiiated transfer function of a sound travelling from the sound source to the user's eardrum.

5. The bedside wellness system according to claim 3, wherein said sound generating means includes at least a pair of speakers.

6. The bedside wellness system according to claim 1, wherein said virtual reality environment providing means includes a means for adjusting the hardness of a bed on which the user lies, a means for adjusting the temperature of the inside of the bed, and a means for adjusting the humidity of the inside of the bed, and wherein said control means controls said hardness adjusting means, said temperature adjusting means, and said humidity adjusting means according to an image of the virtual reality environment to be provided by said virtual reality environment providing means.

7. The bedside wellness system according to claim 6, wherein said hardness adjusting means is a means for adjusting the hardness of the bed by adjusting the pressure of fluid included in the bed such as air, water, or gel liquid, said temperature adjusting means is a means for adjusting the temperature of the fluid, and said humidity adjusting means is a means for adjusting the humidity of air fed into the bed.

8. The bedside wellness system according to claim 6, wherein said hardness adjusting means is a means for adjusting the hardness of the bed by adjusting the pressure of a mat which is placed under the user, said temperature adjusting means is a means for adjusting the temperature of a predetermined position of the mat, and said humidity adjusting means is a means for adjusting the humidity of air emitted out of the mat.

9. The bedside wellness system according to claim 1, wherein said virtual reality environment providing means includes an image display means for displaying an image of the virtual reality environment according to the contents of the virtual reality environment for the user who lies in bed, and a means for movably supporting said image display means and positioning it at a desired position.

10. The bedside wellness system according to claim 1, wherein said virtual reality environment means includes an image display means having a screen which is so shaped as to surround the face of the user who lies in bed, and on which an image of the virtual reality environment is displayed.

11. The bedside wellness system according to claim 1, wherein said control means includes a means for informing an operator of the user's physiological condition evaluated by said physiological and psychological condition evaluating means, and a means for receiving an instruction input by the operator so as to control the load of the physical exercise provided by said exercise load providing means according to the instruction.

12. The bedside wellness system according to claim 1, wherein the information acquired by the physiological and psychological condition evaluating means includes the user's heart rate, blood pressure and respiration pattern.

* * * * *